United States Patent [19]

Avery

[11] 4,186,504

[45] Feb. 5, 1980

[54] DISPLAY MARKER DEVICE

[76] Inventor: John R. Avery, 523 Detroit St., Denver, Colo. 80206

[21] Appl. No.: 847,060

[22] Filed: Oct. 31, 1977

[51] Int. Cl.[2] ..... B42F 21/00

[52] U.S. Cl. ..... 40/359; 40/159

[58] Field of Search ..... 40/405, 159, 360, 359, 40/124.2; 116/119; 281/15 A, 42; 211/46

[56] References Cited

U.S. PATENT DOCUMENTS

| | | | |
|---|---|---|---|
| 1,294,948 | 2/1919 | Rand | 40/360 |
| 1,999,583 | 4/1935 | Bouvier | 281/42 |
| 2,198,191 | 4/1940 | Wheeler | 281/42 |
| 2,435,221 | 2/1948 | Jones | 40/360 |
| 2,918,921 | 12/1959 | Carlston | 40/159 X |
| 3,555,713 | 1/1971 | Leinbach | 40/159 |
| 3,684,340 | 8/1972 | Kikorian | 281/15 A X |
| 3,885,726 | 5/1975 | Fridlund | 40/359 |
| 3,977,527 | 8/1976 | Rose et al. | 211/46 |
| 4,064,645 | 12/1977 | Wood | 40/159 |

*Primary Examiner*—John F. Pitrelli
*Assistant Examiner*—Wenceslao J. Contreras
*Attorney, Agent, or Firm*—Sheridan, Ross, Fields & McIntosh

[57] ABSTRACT

A display marker device is provided which has a body sheet with an open-ended sleeve formed along one edge and an edge tab or marker arranged along at least one of the other edges. An elongated member can be inserted in the sleeve for hanging or supporting the sheet. The elongated member can be arranged so that one or both ends can be clamped in an object or supported on spaced members so that the device is suspended. Advertising displays or designs can be printed or adhered to the face of the body sheet or one or more transparent sheets can be joined to the body sheet to form pockets which can hold advertising or informational pages. The display device can also be used as a book marker or a book can be supported by its binding by being draped over the elongated member of the device. A support case which is mountable on a vertical surface such as a wall and sized to receive the marker device and a book supported thereon can be provided. The top of the case is open with the ends spaced to receive the ends of the elongated support member.

1 Claim, 6 Drawing Figures

Fig.-1
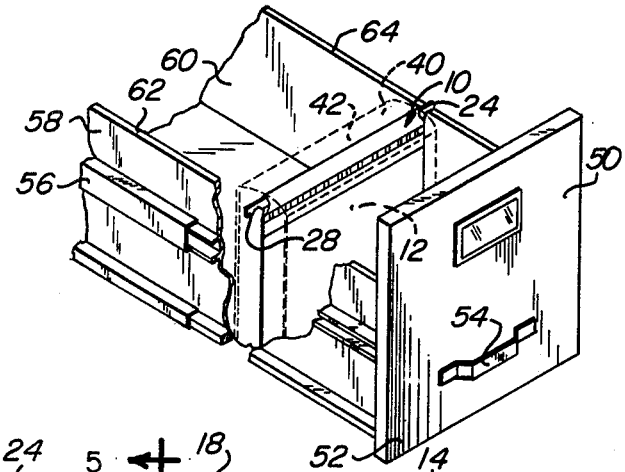
Fig.-2
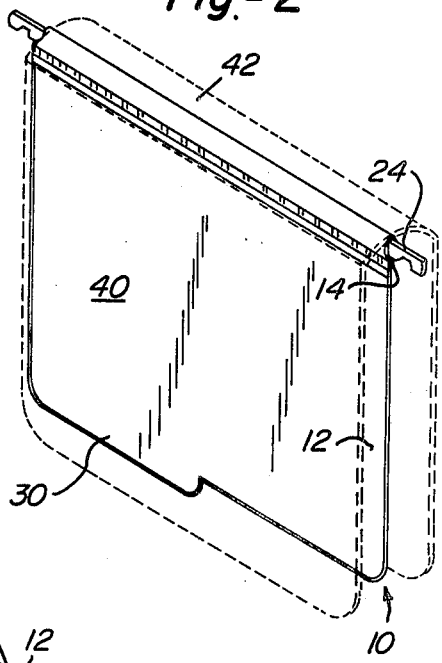
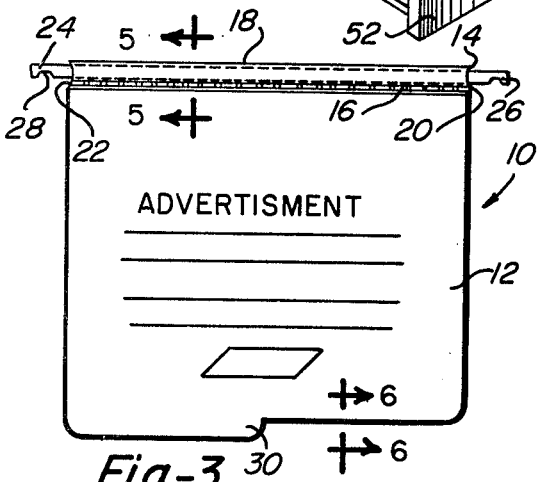
Fig.-3
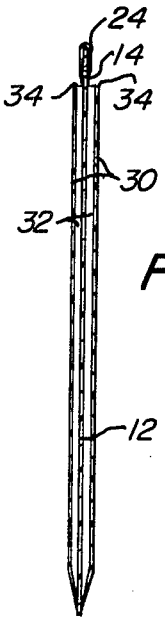
Fig.-4
Fig.-5
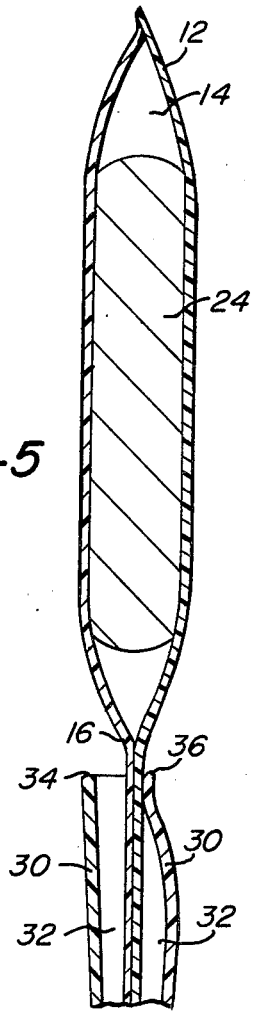
Fig.-6
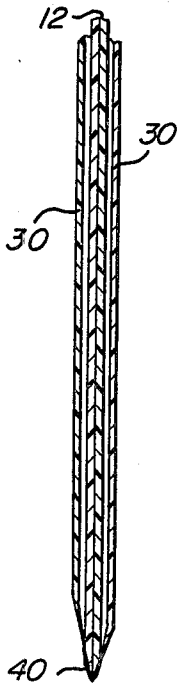

DISPLAY MARKER DEVICE

BACKGROUND OF THE INVENTION

1. Field of the Invention

This invention is directed to a device which can be used for displaying or advertising desired information.

2. The Prior Art

The applicant hereby lists the pertinent prior art of which he is aware:

| | |
|---|---|
| U.S. Pat. No. 3,298,374 | U.S. Pat. No. 3,801,175 |
| U.S. Pat. No. 3,572,867 | U.S. Pat. No. 3,826,582 |
| U.S. Pat. No. 3,684,340 | U.S. Pat. No. 3,899,082 |
| U.S. Pat. No. 3,790,242 | U.S. Pat. No. 3,936,201 |

The Grundell patent (U.S. Pat. No. 3,298,274) shows in FIG. 6 an arrangement whereby a device is fastened to the binding of a book and is inserted through a support channel which can be suspended between two rails. The patent to Cooper (U.S. Pat. No. 3,572,867) in FIG. 1 shows end pieces which extend beyond the edges of the cover of a file and are arranged to be supported on a pair of parallel rods. The Kirkorian patent (U.S. Pat. No. 3,684,340) is cited primarily for the arrangements shown in FIGS. 1 and 4, wherein the enlarged cross-sectional bead is secured in the binding of a file and the bead is arranged to be inserted or supported in the channel of a suspended hanger element. The patent to Sullivan (U.S. Pat. No. 3,790,242) shows in FIG. 1, a carrier for attachment to a binder, such as a binder for computer printouts, and a channel type supporting structure for the insertion and suspension of the carrier. The Giulie patent (U.S. Pat. No. 3,801,175) shows a combination hanger and binder unit in FIG. 2, wherein a sheath of papers can be bound together by a binder unit and hangers provided in each end of binder unit can be extended for engaging spaced support members for suspending the papers. The Podosek patent (U.S. Pat. No. 3,826,582) shows a hook arrangement for suspension of bound loose-leaf file assemblies, as shown in FIG. 1, for suspending the file from a single support member. The Young et al., U.S. Pat. No. 3,899,082, discloses a binder storage support arrangement using flexible lightweight frame hangers as disclosed in FIGS. 5 and 7. The Kenney et al., U.S. Pat. No. 3,936,201, in FIGS. 1 and 3, shows a pair of hanger and sheet lifters for ring binders whereby the binder may be hung on spaced parallel rails in a suspended arrangement.

The prior art is primarily directed to various arrangements for suspending files, books, sheets of paper, etc., in an arrangement whereby some kind of a support hanger or structure is inserted as part of the binding of the object and in most cases both elongated ends of the hanger are arranged to contact and be supported by several objects. These arrangements are fairly ineffective for the intended purpose of the present invention in that no advertising or display of any type is or can be provided in any of these devices. One of the factors involved in a device like this is cost, and the ability to write off cost or provide other novel features which can be a considerable cost saving measure or one in which some value can be recouped in addition to providing a convenience for the user.

The present invention takes a different approach. In order to make the device worthwhile for use and, thus, become a decided improvement over the prior art, it has been found advantageous to provide a device which is useful for advertising and displaying information or other forms of media that will have decided appeal or benefit. In addition, it is also desirable to provide support functions for various bound objects, especially for storage purposes. Contrary to the prior art, the present invention does not directly join or connect the object. This is to say that the device of the present invention can merely be inserted between the pages of the object to act as a book mark, divider and/or support without actually being joined or physically connected to the binding or edge of the object.

It is therefore an object of the present invention to provide a display marker device which can be utilized to provide information for display advertising for the purposes of retail selling or distribution of desired information.

Another object of the present invention is to provide a device which can be used to mark or organize a plurality of objects such as books, sheets, files, etc., to categorize and classify these items into proper locations.

A still further object of the present invention is to provide a device which can be utilized to support objects such as bound volumes for convenient and accessible storage and to protect the objects from damage or wear.

A still further object of the present invention is to provide a simple and cheap display marking device which can be readily manufactured at such a low cost that it can be given away or distributed to the public for dissemination of information and provide a useful object which will be retained by the user.

SUMMARY OF THE INVENTION

This invention provides a display marker device which has a relatively flexible thin sheet-like body upon which can be printed or placed various types of information such as advertising, designs, or data for ready and continued reference. The body sheet can have an open ended marginal sleeve along one edge in which an elongated member can be inserted to provide rigidity for the body sheet and suspend or support the sheet in a desired position for viewing. One or more of the opposite edges of the body can have outwardly extending tabs to readily display information that may be necessary. The body sheet and tabs can be formed from flexible plastics, metals, or synthetic materials that are relatively cheap, flexible, and yet provide good wear and display characteristics. If desired, additional transparent sheets may be fastened along one or more edges to the body sheet to provide transparent pockets for holding data, advertising, or other informational pages which are desired to be displayed or stored.

In order to support or suspend the display device in the desired position, an elongated rigid member can be inserted through the sleeve and arranged to extend beyond each intersecting edge of the body sheet so that the device can be suspended by either one or both of the ends of the support member. If desired, notches or grooves can be provided near the ends of the member for engaging the support objects to prevent slippage or disengagement of the device from the supports.

As an added feature, the display device can be inserted between the pages of a bound volume such as a telephone directory or catalogue with the rigid support member positioned adjacent the binding of the book so that the book and device can be draped over and suspended by the support member from spaced objects, such as the rails in a file cabinet or drawer.

Another embodiment of the present invention includes a support case which can be mounted on a vertical surface such as a wall. The case has an open top and is sized to receive a bound volume supported by the display device. Opposite sides of the case are spaced to receive the ends of the support member of the device. Display information can be also placed on the sides of the case to compliment or add to the display of the marker device.

Other objects and features of this invention will appear in the following description and appended claims, reference being made to the accompanying drawings forming a part of the specification, wherein like reference characters designate corresponding parts in the several views.

DESCRIPTION OF THE DRAWINGS

FIG. 1 is a perspective view of a file drawer with a bound volume suspended within said drawer by the display device according to the present invention;

FIG. 2 is a perspective view of the display device with the body of the device inserted between the pages of a bound volume with the elongated support member adjacent and parallel to the bound edge of the volume and the size of the body sheet approximating the size of the pages of said volume;

FIG. 3 is a side view of the display body of the present invention showing the marginal sleeve along the upper edge with the support member inserted therein and the tab member provided along the opposite edge;

FIG. 4 is a side elevation view of the display device according to the present invention showing transparent sheets attached along the outer surfaces of the body sheet to form pockets for containing display materials;

FIG. 5 is a partial enlarged section view taken along lines 5—5 of FIG. 3 showing the sleeve arrangement for containing the support member and the upper edge of the pocket sheets with the pocket along the right side sealed to completely enclose the material therein with the pocket along the left side having an open edge for insertion or removal of the contents; and FIG. 6 is a partial enlarged sectional view taken along lines 6—6 of FIG. 3 showing the bottom edges of the transparent pocket sheets and their attachment along the edge of the body sheet.

DETAILED DESCRIPTION OF THE EMBODIMENTS

Turning now to FIG. 3, there is shown a display device 10, according to the present invention, which has a body sheet 12 usually in a rectangular shape which is sized to fit various books or pages of bound volumes with which the device can be used. Either one or both sides of the body sheet 12 can have inscriptions, advertisements, designs or the like printed or mounted for pleasing effect and also to transmit information as desired. One of the edges, usually of the longer dimension, is provided with a sleeve 14 formed by hemming the marginal edge of the sheet 12 along a line 16. The hemming effect can be obtained by any method desired such as by stitching with thread or by spot or seam welding of the plastic material.

In one embodiment, the sheet 12 is formed by folding over and doubling a thin plastic sheet with the fold line along the outer edge 18 and the remainder of the edges heat welded around the entire sheet to form a unitary relatively flexible durable body. The ends 20, 22 of the sleeve 14 remain open for the insertion of an elongated support member 24. The ends 26 of the support member 24 are arranged to extend beyond each edge of the sheet 12 to provide extensions or flanges which can be used to overlie a pair of support objects for suspending the display device 10. If desired, an inverted notch 28 can be provided in each end 26 to engage a support rail or object to prevent the display device from being easily dislodged.

Along the opposite edge of the sheet 12 from the open sleeve 14, a tab 30 can be provided which can be arranged to extend along and slightly beyond the normal edge profile. This tab is used for locating desired pages when placed in a bound volume, and also can contain data or information. A tab can also be provided along either one or both of the intersecting edges of the sheet to provide the same function as tab 30. The side tabs can be in addition to or as a substitute for tab 30.

FIG. 4 shows the sheet 12, sleeve 14, and an elongated member 24 positioned therein. One or more transparent pockets 32 can be provided on one or both sides of the body sheet 12. These pockets can be full sized to cover the entire surface of the body sheet 12 by being attached around the outer edge of the sheet, or can be of any smaller size and arranged as desired across the face of the sheet. Although it is desirable to fabricate these pockets from transparent plastic sheet material, it is also possible to use opaque material for the purpose of providing storage for desired materials or documents. In most cases, it is desirable to use the transparent material so that the contents of the pocket can be readily observed from the exterior.

The pockets 32 which are formed by the sheets 30 are usually joined around only three edges of the sheet 12, with the fourth edge 34 left open for the insertion or removal of documents or other materials. As best shown in FIG. 5, the open edge of one or more of the pocket sheets 30 can be sealed by heat welding adhesives or any other suitable method to the body sheet 12. In this way, the interior of the pocket 32 formed between the sheet 30 and the body sheet 12 can be sealed to permanently enclose the display contained therein to make the contents impervious to weather, moisture, or other dilatorious atmosphere.

Also it can be seen in FIG. 5 that the support member 24 has a height dimension which is considerably greater than the width to provide the desired support strength. At the same time, the open-ended sleeve 14 is sized to conveniently accommodate the dimensions of the support member 24. In this way, the support member 24 is substantially rigid and can support a considerable weight for additional purposes which will be explained later. As can be seen in FIG. 6, all of the materials of the body sheet 12 are joined together, usually at their edges, by a weld bead 40 or other suitable adhesive arrangement.

As disclosed and described herein, the advertising display device as shown and described can be used by itself to provide advertising functions or disseminate and provide a convenient method for holding desired information and data. In addition, the display device 10 can be used to support bound volumes of pages or sheets such as computer tab runs, telephone books, catalogs or other large volumes of paper which need to be stored in a convenient and handy location. As shown in FIG. 2, the display device 10 can be inserted between the pages of a book 50 with the sleeve 14 and support member 24 arranged usually adjacent to the binding 42 of the volume. The tab 30 is arranged to extend beyond at least one edge of the pages. A particular page or section of the book 40 may be easily marked or designated by the location of the display device 10 between the pages of the book. In this way, the book 40 can be suspended as desired in any convenient and handy location such as a file drawer 50.

As seen in FIG. 1, the file drawer 50 has a front face 52 with a convenient handle 54 provided thereon. Side runners or guides 56 on each side of the drawer provide for easy movement of the drawer within the file cabinet (not shown). The sides 58, 60, of the file drawer 50 usually end in parallel upwardly extending edges 62, 64. It is also possible to substitute elongated parallel rods supported between the front 52 and the rear surface of the drawer 50 as a substitute for the upper edges 62, 64. The book 40 with the advertising display device 10 inserted between the pages can be supported by placing the support member 24 with its flange ends 26 positioned over and contacting the upper edges 62, 64 of the sides 58, 60. The inverted notches 28 can be positioned to coincide with the spacing between the edges 62, 64 so that the notches 28 engage the surfaces to prevent the book from moving laterally to allow the flanges to disengage from the support members.

It is to be understood that any type of mounting arrangement can be utilized with the advertising display device of the present invention. One example of this might be a rectangular box or case open at the top and sized to receive a volume or book such as a telephone directory. The back edges of the support case can have inwardly extending flanges. Fastening devices can be inserted through the flanges for attaching the support to a wall or vertical surface. The spacing between the opposite ends of the case are arranged so that they coincide with the distance between the inverted notches 28 provided on the ends of the support members 24. Thus, a convenient storage housing or case can be provided for a book or oversized volume such as a telephone directory.

It is to be understood that any kind of support arrangement can be provided for use with the display device of the present invention, thus any two spaced objects which are spaced properly to receive the ends of the support members can be utilized as desired. Thus, it is possible to provide a pair of wire brackets suspended or arranged in cantilever fashion from a vertical surface or wall or two objects such as arms of a chair or a basket type arrangement can be utilized to receive and support the display device and any volume that is supported thereby.

The device of the present invention can be fabricated from any suitable materials which can perform the desired function. Thus, the body sheet can be fabricated from plastic, and more especially thermoplastic materials which are heat-sealable or weldable, metal, paper, or any other material which is flexible yet rigid enough to provide the desired display function. The support member can be fabricated from plastic, but is probably more desirably fabricated from a more rigid material such as steel, aluminum, or other metal. Various decorative additions can be provided along edges of the body sheet or the pockets of the present invention with the possibility of corner protectors of reinforced plastic or metal added to reduce the wear on the corners of the body sheet as well as provide additional rigidity in these areas.

While an improved advertising display device has been shown and described in detail, it is obvious that this invention is not to be construed to be limited to the exact form disclosed, and that changes in detail and construction may be made in the invention without departing from the spirit thereof.

What is claimed is:

1. A single device for providing an advertising display while supporting a bound volume and acting as a book marker, comprising:

a display body being a sheet of flat, thin material insertable between pages of the bound volume, said sheet having an elongated open ended sleeve formed along one edge, said sheet having an advertising display arranged along at least a portion of one or both sides of said sheet;

an elongated support member positioned in said sleeve, said support member having a length so that ends thereof extend beyond ends of said sheet to removably engage a rigid supporting structure so that the bound volume is supported over said elongated support member by the rigid supporting structure;

at least one flat, thin, transparent sheet sealed to an outer surface of said display body and having an openable edge so that said transparent sheet forms a pocket for receiving and enclosing an advertising display therein, said thin, transparent sheet being substantially contiguously adjacent said display body when no advertising display is housed in the pocket and said thin, transparent sheet being contiguously adjacent the advertising display when the advertising display is housed in the pocket with the advertising display being contiguously adjacent said outer surface of said display body, the combined thickness of said sheet and said display body being minimized so that the combined display body and sheet is insertable between pages of the bound volume to both support the bound volume and serve as a book marker.

* * * * *